US005729795A

United States Patent [19]

Kavolius et al.

[11] Patent Number: 5,729,795

[45] Date of Patent: Mar. 17, 1998

[54] RECONDITIONING OF ELECTROSTATOGRAPHIC CARTRIDGES

[75] Inventors: Vytas A. Kavolius, Charlottesville; Joseph E. White, Mt. Crawford; Edward D. Furrow, Waynesboro, all of Va.

[73] Assignee: Genicom Corporation, Chantilly, Va.

[21] Appl. No.: 716,092

[22] Filed: Sep. 19, 1996

[51] Int. Cl.[6] ..... G03G 15/00

[52] U.S. Cl. ..... 399/109; 399/111

[58] Field of Search ..... 399/107, 109, 399/110, 111, 113, 119, 252, 258, 262

[56] References Cited

U.S. PATENT DOCUMENTS

| | | | |
|---|---|---|---|
| 4,816,877 | 3/1989 | Keen . | |
| 4,862,210 | 8/1989 | Woolley | 222/DIG. 1 X |
| 5,185,616 | 2/1993 | Wilcke | 399/262 X |
| 5,335,831 | 8/1994 | Foster | 222/DIG. 1 X |
| 5,370,761 | 12/1994 | Chitouras . | |
| 5,381,217 | 1/1995 | Ishida . | |
| 5,392,963 | 2/1995 | Kelly et al. . | |
| 5,404,212 | 4/1995 | Ditomaso . | |
| 5,426,493 | 6/1995 | Oyler . | |
| 5,460,674 | 10/1995 | Chitouras . | |
| 5,525,183 | 6/1996 | Baley . | |
| 5,596,388 | 1/1997 | Ohkubo et al. | 399/111 |

*Primary Examiner*—Sandra L. Brase
*Attorney, Agent, or Firm*—Nixon and Vanderhye P.C.

[57] ABSTRACT

Electrostatographic cartridges having a cartridge base, a toner hopper having a toner fill hole attached to the cartridge base, and a gear housing assembly which blocks access to the toner fill hole and which includes an interior gear housing component integral with the cartridge base are remanufactured by severing the interior gear housing component and then reattaching it to the cartridge base through the exterior gear housing component. Specifically, the one-piece interior gear housing component is severed so that it can be removed thereby providing unobstructed access to the original toner fill hole. Most preferably, the interior part of the gear housing is cut at a five degree angle relative to the cartridge base. The angular cut thereby ensures that the attachment bosses on the cartridge base which serve to couple the base to the toner cartridge cover are not damaged to an extent that would defeat their coupling function. Paired reattachment holes are formed in the interior and exterior gear housing components to allow them to be reattached to one another via screw and nut assemblies extending therethrough. The reattached interior and exterior gear housing components may then be connected to the cartridge base by screws supplied originally with the cartridge by original equipment manufacturer (OEM). In such a manner, fresh toner may be introduced into the toner hopper in a convenient fashion during the remanufacturing operation.

14 Claims, 5 Drawing Sheets

RECONDITIONING OF ELECTROSTATOGRAPHIC CARTRIDGES

FIELD OF INVENTION

The present invention generally relates to the field of electrostatographic cartridges. More specifically, the present invention relates to the reconditioning of electrostatographic cartridges and to the cartridges thereby reconditioned.

BACKGROUND AND SUMMARY OF THE INVENTION

So-called "all-in-one" electrostatographic cartridges are used extensively in non-impact printers and copiers. Recently, efforts have been made to remanufacture such cartridges. However, problems exist during the remanufacturing process whereby the remanufacturer must provide for a method to prevent the new toner from leaking out of the toner hopper component of the cartridge in a manner similar to that employed by the original equipment manufacturer (OEM). Traditionally, flexible thin-film polymeric films are welded or otherwise adhered in place to seal the large opening where toner exits to coat the developer roller in normal use. The end-user removes the seal just prior to use. Therefore, the seal is in reality simply a shipping aid to prevent toner leakage.

Older cartridges designed by OEM's provide for a method for filling the toner hopper after the seal noted immediately above has been installed. More recently, the same OEM's have placed relatively rigid components of the cartridge housing directly in front of the toner fill opening thus preventing or making difficult the process of filling after the plastic film seal has been installed. Filling the cartridge with toner after the seal has been installed is preferred since the alternate—i.e., filling toner through the sealed opening—provides for contamination of the seal surface with toner thus compromising its sealing effectiveness.

What has been need therefore is a technique whereby electrostatographic cartridges could be remanufactured by filling toner through the original toner fill hole whose access is essentially blocked by other structural components of the cartridge housing. It is towards fulfilling this need that the present invention is directed.

Broadly, according to the present invention, the one-piece interior part of the cartridge's gear housing is severed so that it can be removed thereby providing unobstructed access to the original toner fill hole. Most preferably, the interior part of the gear housing is cut at a five degree angle relative to the cartridge base. The angular cut thereby ensures that the attachment bosses on the cartridge base which serve to couple the base to the toner cartridge cover are not damaged to an extent that would defeat their coupling function.

After refilling with fresh toner, the interior and exterior parts of the gear housing are coupled together by means of bolt and nut assemblies. The coupled gear housing may then be reattached to the cartridge base by means of the screws which originally attached only the exterior part of the gear housing to the cartridge base. In such a manner, therefore, the cartridge may be filled with fresh toner directly through the original toner fill hole with the flexible plastic film in place to prevent the problems noted previously.

These and other aspects and advantages of the invention will become more clear after careful consideration is given to the following detailed description of the preferred exemplary embodiments.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
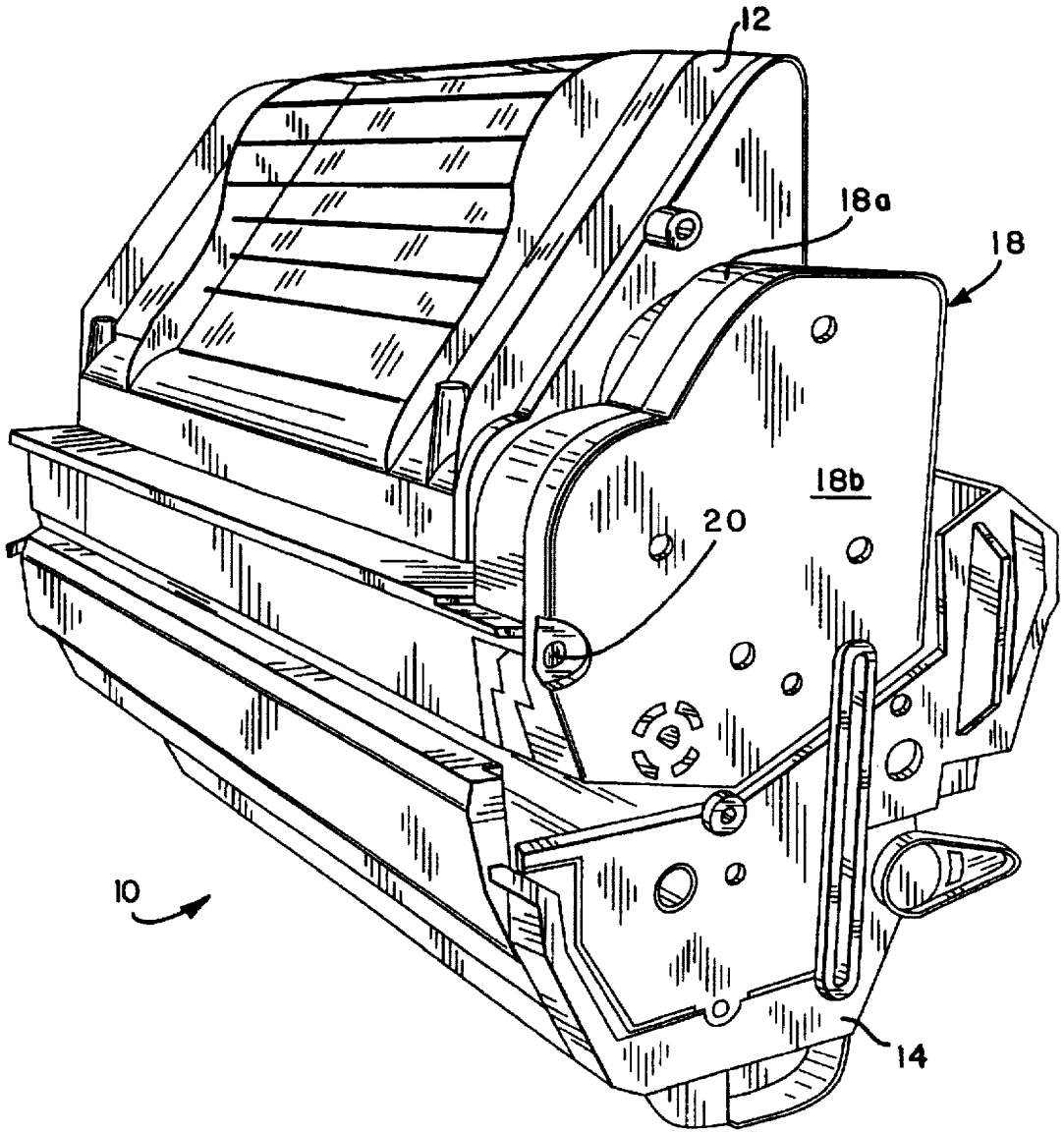
FIG. 1 (PRIOR ART)
FIG. 1 is a perspective view of an exemplary OEM supplied all-in-one electrostatographic cartridge that may be remanufactured according to the present invention.

Accompanying FIG. 1 depicts an OEM "all-in-one" electrostatographic cartridge 10 that may be reconditioned according to the present invention. As is shown, the cartridge 10 generally includes a toner hopper 12 which houses a supply of toner for use in the electrostatographic printing process. The toner hopper 12 is attached to the cartridge base 14 which supports the rotatable charge and developer rollers 16, 18 (see FIG. 3). The rollers 16, 18 are rotated synchronously by a gearing assembly (not shown) housed within a lateral gear housing 18 formed of an interior gear housing component **18*a* and an exterior gear housing component 18*b***.

The interior gear housing component **18*a* is formed as a one-piece structure with the cartridge base 14 and is therefor ordinarily not removable therefrom. The exterior gear housing component 18*b*, on the other hand, is ordinarily removably coupled in registry with the interior gear housing component 18*a* via screws (one of which is visible in FIG. 1 and identified by reference numeral 20). Furthermore, it will be observed that the interior gear housing component 18*a* essentially obstructs access to the toner fill hole 22 which is normally sealed by a removable plug member 24 (see FIG. 3). Thus, the OEM cartridge depicted in FIG. 1 does not provide unobstructed access to the toner fill hole 22** which is highly desirable during remanufacturing for the reasons noted previously.

Figure 2:
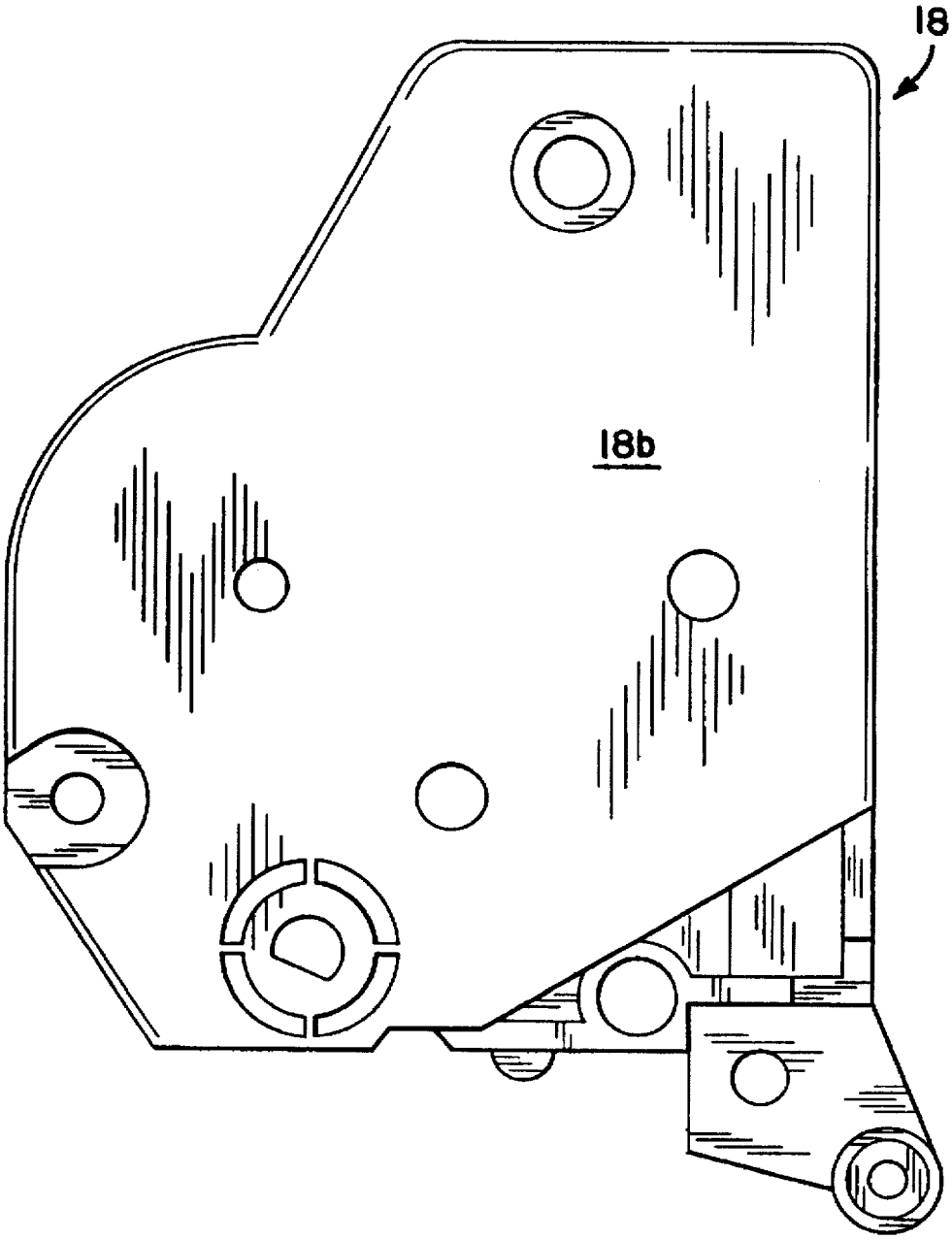
FIGS. 2 and 3 are each end elevational views of the electrostatographic cartridge depicted in FIG. 1, but showing the manner in which access is gained to its original toner fill hole according to the present invention.
Figure 3:
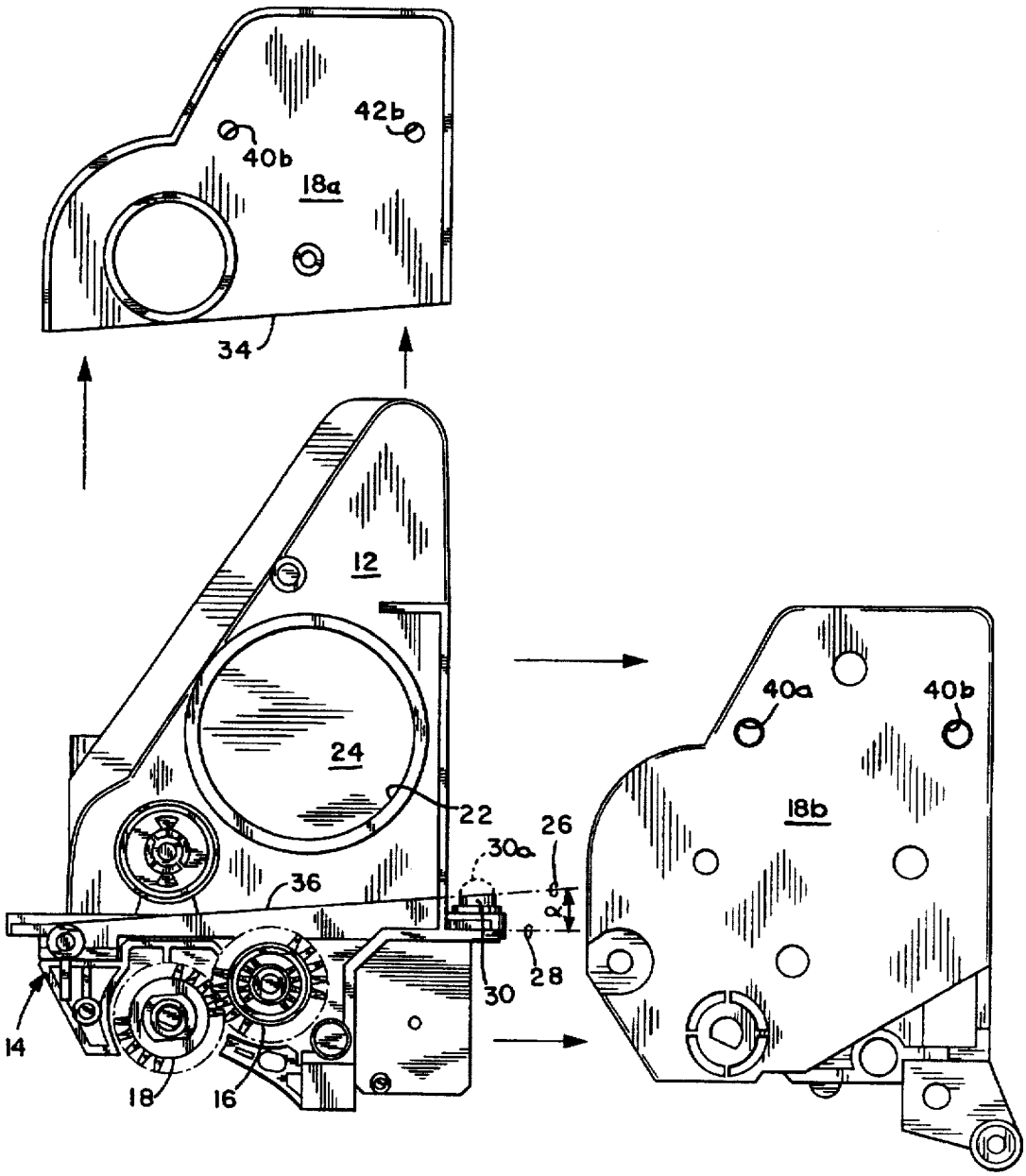
Figure 4:
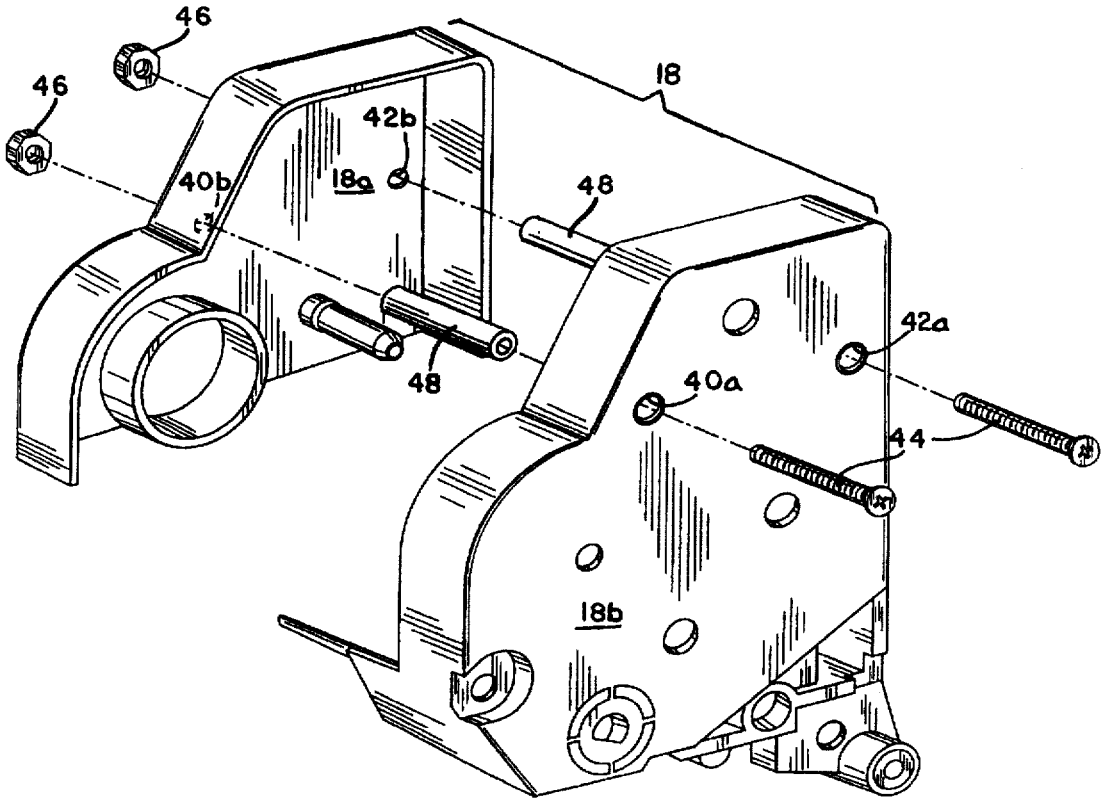
FIG. 4 is a perspective view showing the manner in which the gear housing components may be reassembled after remanufacturing of the cartridge according to this invention.

FIGS. 2–4, however, depict the manner in which the cartridge 10 can be modified according to the present invention in order to permit unobstructed access to the toner fill hole 22. In this regard, the exterior gear housing component **18*b* is first removed in a normal fashion to allow the gear assembly (not shown) housed thereby to be removed. The interior gear housing component 18*a* may then be severed along a parting plane 26 which is oriented at an angle $\alpha$ relative to the connection plane 28 between the toner hopper 12 and the cartridge base 14**.

It will be observed in FIG. 3 that severing of the normally one-piece interior gear housing component **18*a* is accomplished without sacrificing the structural integrity of the connection boss 30 which serves to rigidly connect the toner hopper 12 to the cartridge base 14. Thus, a relatively small portion (noted in FIG. 3 by reference numeral 30*a*) will be removed from the boss 30 due to the severing operation, but such portion will not affect adversely the connection function served by the boss 30. For this reason, the parting plane 26 along which the interior gear housing component 18*a* is severed should be such that angle $\alpha$ is between about 2° to about 8°, and more preferably about 5°. The interior gear housing component 18*a* after being severed will thus have a lower edge 34 which mates with a similar edge 36 associated with the cartridge base 14**.

With the interior gear housing component 18*a* removed in the manner described above, the cartridge remanufacturer will thus have unobstructed access to the toner fill hole 22. As such, the plug member 24 may be removed to allow fresh toner to be introduced into the toner hopper 12 through the fill hole 22. After fresh toner has been introduced into the toner hopper 12, the plug member 24 may be replaced.

The interior and exterior gear housing components 18*a*, 18*b* are subjected to a drilling and tapping operation so as to form paired reattachment holes 40*a*, 40*b* and 42*a*, 42*b*, respectively, as shown in FIGS. 3 and 4. The paired reattachment holes 40*a*, 40*b* and 42*a*, 42*b* thus allow the interior and exterior gear housing components 18*a*, 18*b* to be reattached to one another using bolts 44, nuts 46 and internal spacers 48 (see FIG. 4). (Although not depicted in drawing FIG. 4, the gear assembly needed to synchronously rotate rollers 16, 18 must first be installed prior to reassembly of the gear housing components 18*a*, 18*b*.) If desired, the exterior housing member 18*b* need not be that originally supplied with the cartridge 10. Instead, a new exterior housing member 18*b* (e.g., bearing the remanufacturer's logo) may be provided, in which case it is reattached to the interior gear housing component 18*a* which was severed from the original cartridge 10 as described previously.

Figure 5:
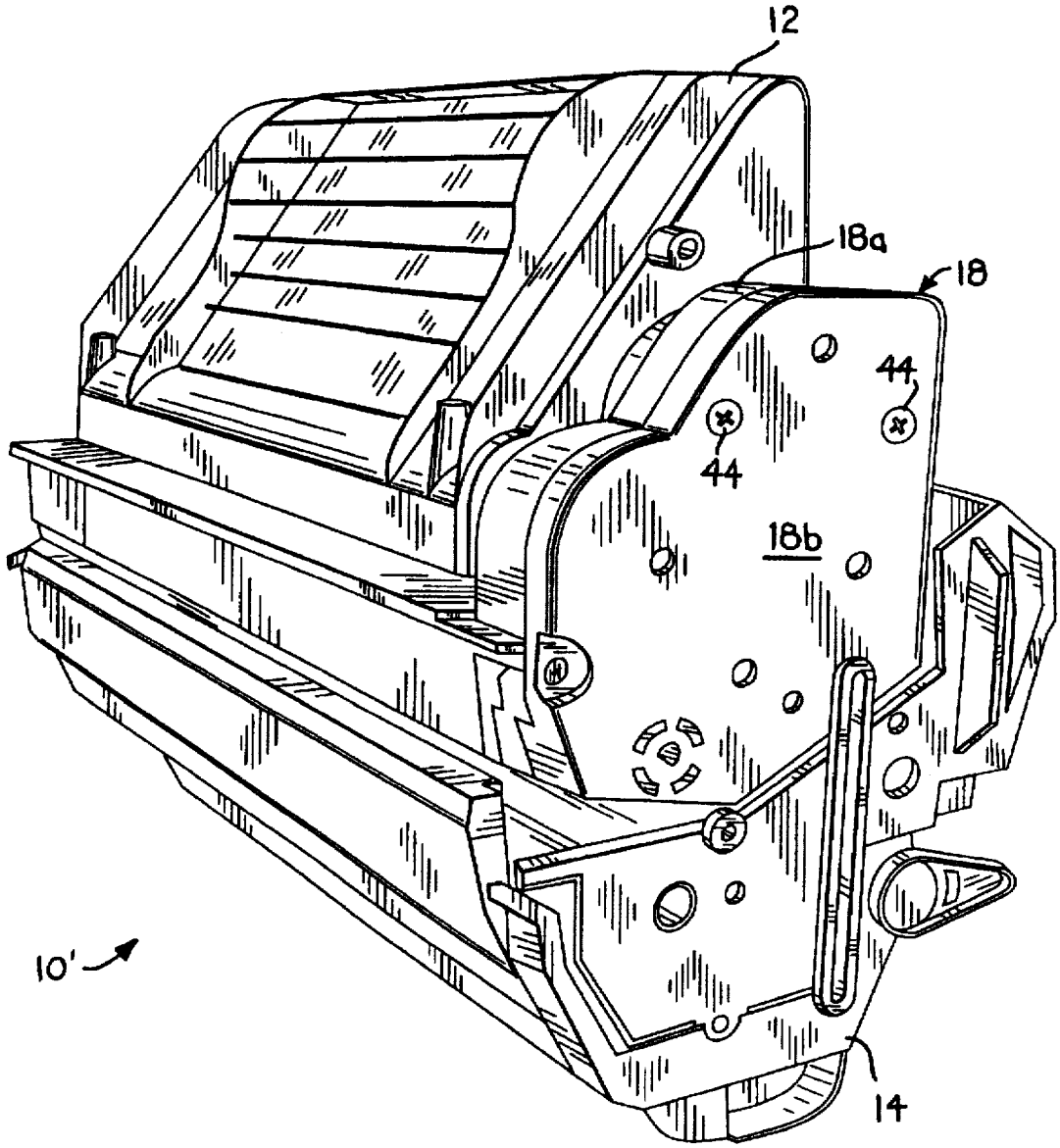
FIG. 5 is a perspective view of the remanufactured electrostatographic cartridge according to this invention.

The thus reassembled gear housing 18 may then be reattached to the cartridge base 14 using the attachment screws (e.g., screw 20) present in the OEM cartridge 10 to normally attach only the exterior gear housing component 18*b*. The interior gear housing component 18*a* will thus be attached to the cartridge base 14 through the exterior gear housing assembly 18*b* via the bolt and nut assemblies 44, 46. The completed remanufactured electrostatographic cartridge 10' is therefore shown in FIG. 5.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of reconditioning an electrostatographic cartridge having a cartridge base, a toner hopper having a toner fill hole attached to the cartridge base and a gear housing assembly which blocks access to the toner fill hole and which is comprised of an interior gear housing component integral with the cartridge base, and a removable exterior gear housing component, said method comprising the steps of:

(i) removing the exterior gear housing component from the interior gear housing component;

(ii) severing the interior gear housing component from the cartridge base to allow access to the toner fill hole of the toner hopper;

(iii) reattaching the severed interior gear housing component to an exterior gear housing component to form a completed gear housing assembly; and (iv) attaching the gear housing assembly to the cartridge base.

2. The method of claim 1, wherein step (ii) is practiced such that the interior gear housing component is severed at an angle α relative to the cartridge base.

3. The method of claim 2, wherein angle α is between about 2° to about 8°.

4. The method of claim 2, wherein angle α is about 5°.

5. The method of claim 1, wherein step (iii) includes drilling at least one pair reattachment holes through the interior and exterior gear housing components, and then reattaching the interior and exterior gear housing components to one another by screw and nut assemblies extending through said at least one pair of reattachment holes.

6. The method of claim 1, further comprising after steps (ii), the step of replenishing the toner hopper by introducing fresh toner through the toner fill hole.

7. The method of claim 6, wherein said step of replenishing the toner hopper includes removing a plug member from the toner fill hole, introducing fresh through the fill hole, and thereafter reinserting the plug member into the fill hole so as to plug the same.

8. The method of claim 1, wherein the toner hopper and the cartridge base are joined to one another along a connection plane by means of at least one raised connection boss, and wherein step (ii) is practiced such that the interior gear housing component is severed at an angle α relative to the connecting plane and such that an upper portion of said at least one boss is removed.

9. A reconditioned electrostatographic cartridge comprising:

a cartridge base;

a toner hopper connected to said cartridge base and having a toner fill hole at one end thereof; and a gear housing connected to said cartridge base at said one end of said toner hopper so as to obstruct said fill hole thereof, wherein said gear housing includes, an interior gear housing component having a lower edge formed by severing said interior gear housing from said cartridge base; and an exterior gear housing component connected to said interior gear housing component and to said cartridge base, said interior gear housing component being thereby connected to said cartridge base through said exterior gear housing component.

10. The reconditioned cartridge of claim 9, the interior gear housing component is severed at an angle α relative to the cartridge base.

11. The reconditioned cartridge of claim 10, wherein angle α is between about 2° to about 8°.

12. The reconditioned cartridge of claim 10, wherein angle α is about 5°.

13. The reconditioned cartridge of claim 10, wherein said toner hopper and said cartridge base are joined to one another along a connection plane by means of at least one raised connection boss, and wherein an upper portion of said boss is severed at an angle corresponding to said angle α.

14. The reconditioned cartridge of claim 9, wherein said interior and exterior gear housing components include at least one pair of drilled reattachment holes therethrough, and a screw and nut assembly extending through said at least one pair of reattachment holes to attach said interior and exterior gear housing components one to another.

* * * * *